US007805866B1

(12) United States Patent
Osgood

(10) Patent No.: US 7,805,866 B1
(45) Date of Patent: Oct. 5, 2010

(54) STABILIZED FLOAT MECHANISM FOR MATERIAL-MOVING IMPLEMENT

(75) Inventor: Kevin R. Osgood, Reading, VT (US)

(73) Assignee: Ralph L. Osgood, Inc., Claremont, NH (US)

( * ) Notice: Subject to any disclaimer, the term of this patent is extended or adjusted under 35 U.S.C. 154(b) by 0 days.

(21) Appl. No.: 12/430,943

(22) Filed: Apr. 28, 2009

(51) Int. Cl.
*E02F 3/32* (2006.01)

(52) U.S. Cl. ..... 37/444; 172/784

(58) Field of Classification Search ..... 37/231, 37/232, 266, 443–445, 274, 281; 172/272–275, 172/784, 815; 414/724–726, 480
See application file for complete search history.

(56) References Cited

U.S. PATENT DOCUMENTS

| | | | | | |
|---|---|---|---|---|---|
| 3,589,450 | A * | 6/1971 | Price | 172/273 |
| 4,127,951 | A * | 12/1978 | Hatch | 37/231 |
| 4,222,442 | A | 9/1980 | Westendorf et al. | |
| 4,596,081 | A * | 6/1986 | DeBilly et al. | 37/281 |
| 4,944,104 | A * | 7/1990 | Kowalczyk | 37/231 |
| 5,400,859 | A * | 3/1995 | Harrell | 172/219 |
| 6,168,369 | B1 * | 1/2001 | Bright et al. | 414/724 |
| 6,751,894 | B2 * | 6/2004 | Verseef | 37/266 |
| 7,089,692 | B2 | 8/2006 | Strait | |
| 7,107,709 | B2 * | 9/2006 | Hamel | 37/232 |
| 7,131,221 | B2 * | 11/2006 | Schmeichel | 37/232 |
| 7,360,327 | B2 | 4/2008 | Osgood et al. | |
| 7,491,027 | B1 * | 2/2009 | McFarland et al. | 414/724 |
| 2006/0288616 | A1 | 12/2006 | Strait | |
| 2008/0028643 | A1 | 2/2008 | Osgood et al. | |

* cited by examiner

*Primary Examiner*—Robert E Pezzuto
(74) *Attorney, Agent, or Firm*—Michael J. Weins; Jeffrey E. Semprebon

(57) ABSTRACT

A float mechanism for movably attaching an implement to a vehicle has a mounting frame that connects onto the vehicle and a fixed frame that affixes to the implement. A pivot bracket pivotally attaches to one of the frames and is slidably connected to the other to accommodate a limited degree of translational motion. The pivot bracket can slidably connect to the frame by a pair of guides in combination with a pair of sleeves. Rotational motion between the fixed frame and the mounting frame can be limited by slots in one of the frames that are slidably engaged by a stabilizing element on the other frame. When the stabilizing element is a horizontal bar, it can engage a pair of vertical slots. To optionally eliminate the free motion between the frames, movable blocks can be employed to limit the motion of each stabilizing element in its slot.

18 Claims, 7 Drawing Sheets

Figure 7
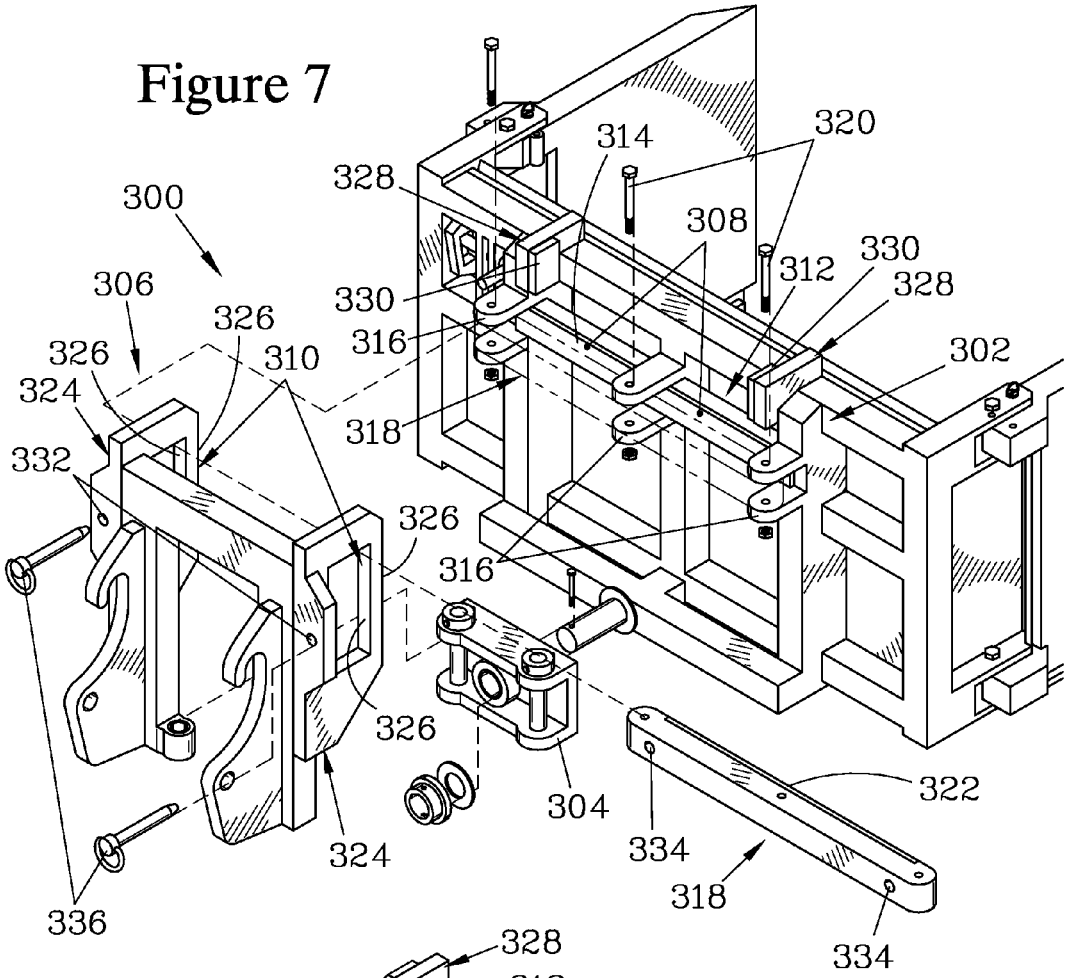
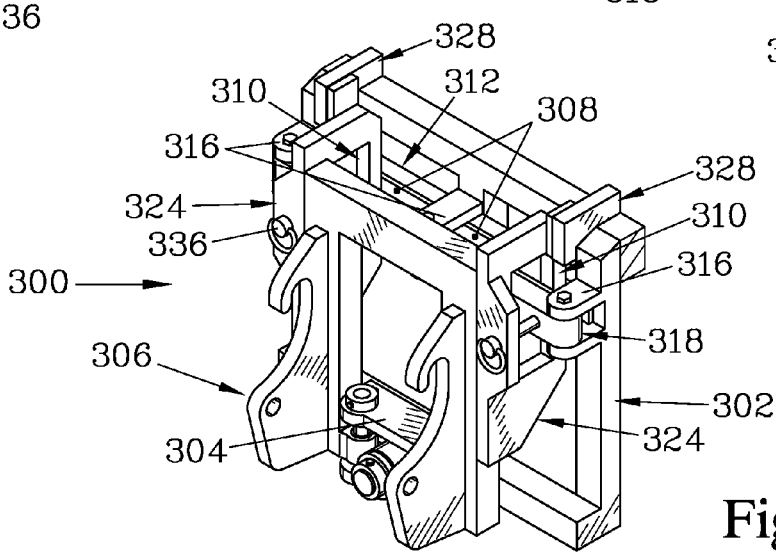
Figure 8

STABILIZED FLOAT MECHANISM FOR MATERIAL-MOVING IMPLEMENT

FIELD OF THE INVENTION

The present invention relates to a mechanism for attaching an implement such as a snowplow onto a vehicle while allowing some free motion of the implement in service.

BACKGROUND OF THE INVENTION

Float mechanisms are employed for mounting material-moving implements such as loader buckets and snowplows onto vehicles. The float mechanism allows a limited degree of free motion of the implement, allowing it to accommodate uneven terrain surfaces. Preferably, the float mechanism is designed to attach to an instant transfer connector on the vehicle to allow the implement, with the float mechanism attached thereto, to be readily removed for transportation, use on a different vehicle, or to free the vehicle for other uses. One such float mechanism is taught in U.S. Publication 2008/0028643.

While the float mechanism taught in the '643 publication offers a significant improvement over earlier implement mounting structures, it has been found to suffer from limited stability under some operating conditions. When mounted to a wheeled vehicle having relatively low-pressure tires, it has been found the bouncing of such vehicles over relatively uneven surfaces results in an undesirable degree of pitching of the implement due to the free play in the float mechanism.

SUMMARY

The present invention is for a float mechanism for attaching a material-moving implement such as is taught in the U.S. Pat. No. 7,360,327 to an instant transfer connector on a vehicle. One such instant transfer connector is available from Caterpillar Inc. The float mechanism allows the material-moving implement a limited degree of free motion relative to the instant transfer connector on the vehicle to accommodate irregularities in the surface over which the vehicle and the material-moving equipment travel.

The float mechanism has a mounting frame which has a pair of substantially vertical supports affixed at a set separation configured to slidably and lockably engage the instant transfer connector which is attached to the vehicle. A fixed frame is attached to the material-moving implement, and may be formed as an integral part of the implement.

A pivot bracket is pivotally attached with respect to one of the frames about a pivot bracket axis and is slidably connected with respect to the other of the frames so as to accommodate a limited degree of translational motion sliding along a nominally vertical axis. The pivot bracket serves to maintain the motion of the fixed frame relative to the mounting frame within the nominally vertical plane while allowing limited translation between the frames, and thereby prevents unintended pitching of the material-moving implement.

The slidable connection of the pivot bracket to one of the frames can be provided by a pair of guides that are fixed to either the pivot bracket or the frame, in combination with a pair of sleeves that are affixed to the other of these elements. Stops on the guides can be employed to limit the translational motion between these elements.

In some applications, it can also be beneficial to limit the rotational motion between the fixed frame and the mounting frame. This motion could be limited by one or more stops affixed to one of the frames or to the pivot bracket. However, to reduce the bending moments on the pivot bracket resulting from loads due to the scraping action of the material-moving implement, it is preferred to limit the rotation by a mechanism that is substantially spaced apart from the pivot bracket which, in addition to limiting the rotation of the frames, also serves to guide the motion along a path that maintains the two frames in parallel relationship. This action can be provided by one or more slots in one of the frames, and one or more corresponding stabilizing elements on the other of the frames, configured to slidably engage the slot(s), thereby providing limited motion in a plane that is substantially normal to the pivot bracket axis.

In one embodiment, a horizontally-extending transfer bar affixed to either the mounting frame or the fixed frame slidably engages one or more substantially vertical slots in the other frame. Providing a pair of substantially vertical slots that are spaced apart will tend to balance the forces to reduce wear and reduce the likelihood of binding.

When one or more slots in combination with one or more stabilizing elements are employed to limit rotational motion between the fixed frame and the mounting frame, movable blocks can be employed to deactivate the float mechanism and prevent free movement. These blocks can be positioned to block a portion of the slot(s) to prevent movement of the stabilizing element(s) therein. Preventing free movement can be particularly advantageous when the float mechanism is employed with a loading bucket during loading operations, to prevent any motion that could result from uneven loading.

BRIEF DESCRIPTION OF THE FIGURES

FIGS. 7 and 8 are isometric views showing an embodiment having a fixed frame that is provided with a pair of horizontal guide slots, each of which is slidably engaged by a vertically-extending transfer post affixed to the mounting frame. FIG. 7 shows the float mechanism partly exploded.

FIG. 8 is an isometric view showing the float mechanism shown in FIG. 7 when assembled and where relative motion between the frame members can be prevented by locking pins that engage both a mounting frame and at least one of the bars that define the horizontal guide slots.

DETAILED DESCRIPTION

Figure 1:
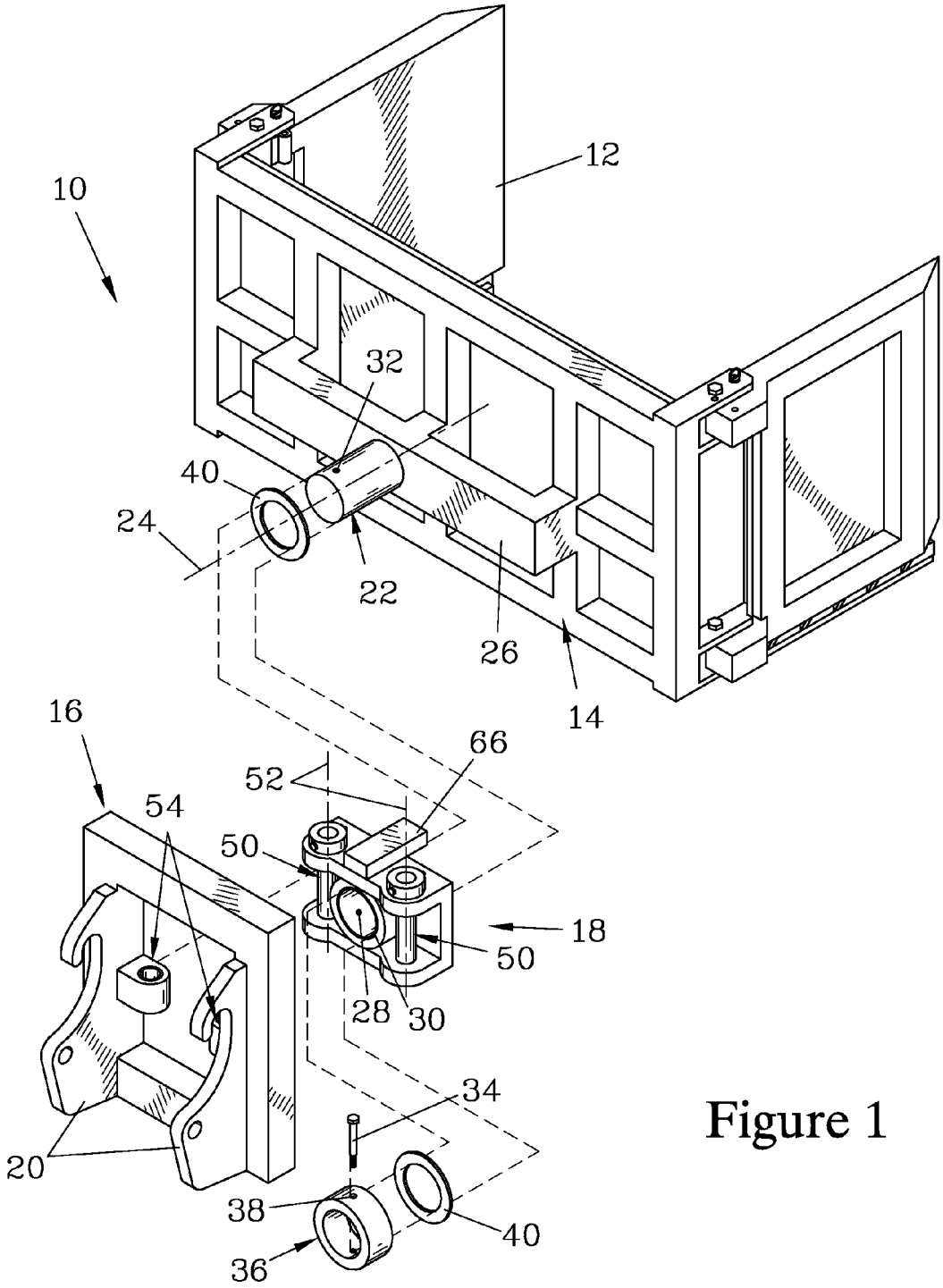
FIG. 1 is a partially-exploded isometric view showing a float mechanism that forms one embodiment of the present invention, the float mechanism serving to support a material-moving implement. The float mechanism has a fixed frame that is affixed to the implement and a mounting frame that has a pair of vertical members configured to attach to an instant transfer connector of a vehicle (not shown). The fixed frame has a centrally-positioned cross-brace with a pivot shaft affixed thereto. A pivot bracket is pivotably attached to the pivot shaft so as to rotate with respect to the fixed frame about a pivot bracket axis. The pivot bracket in turn has a pair of guides that are slidably engaged by sleeves on the mounting frame. The guides extend along a plane that is normal to the pivot bracket axis; in service, the guides are positioned so as to generally extend vertically. The guides pass through top and bottom plates that limit the translation of the sleeves thereon. The rotation of the pivot bracket with respect to the fixed frame can be limited by a bracket stop protrusion that extends from the top plate so as to engage the cross brace of the fixed frame to limit rotation of the pivot bracket.
Figure 2:
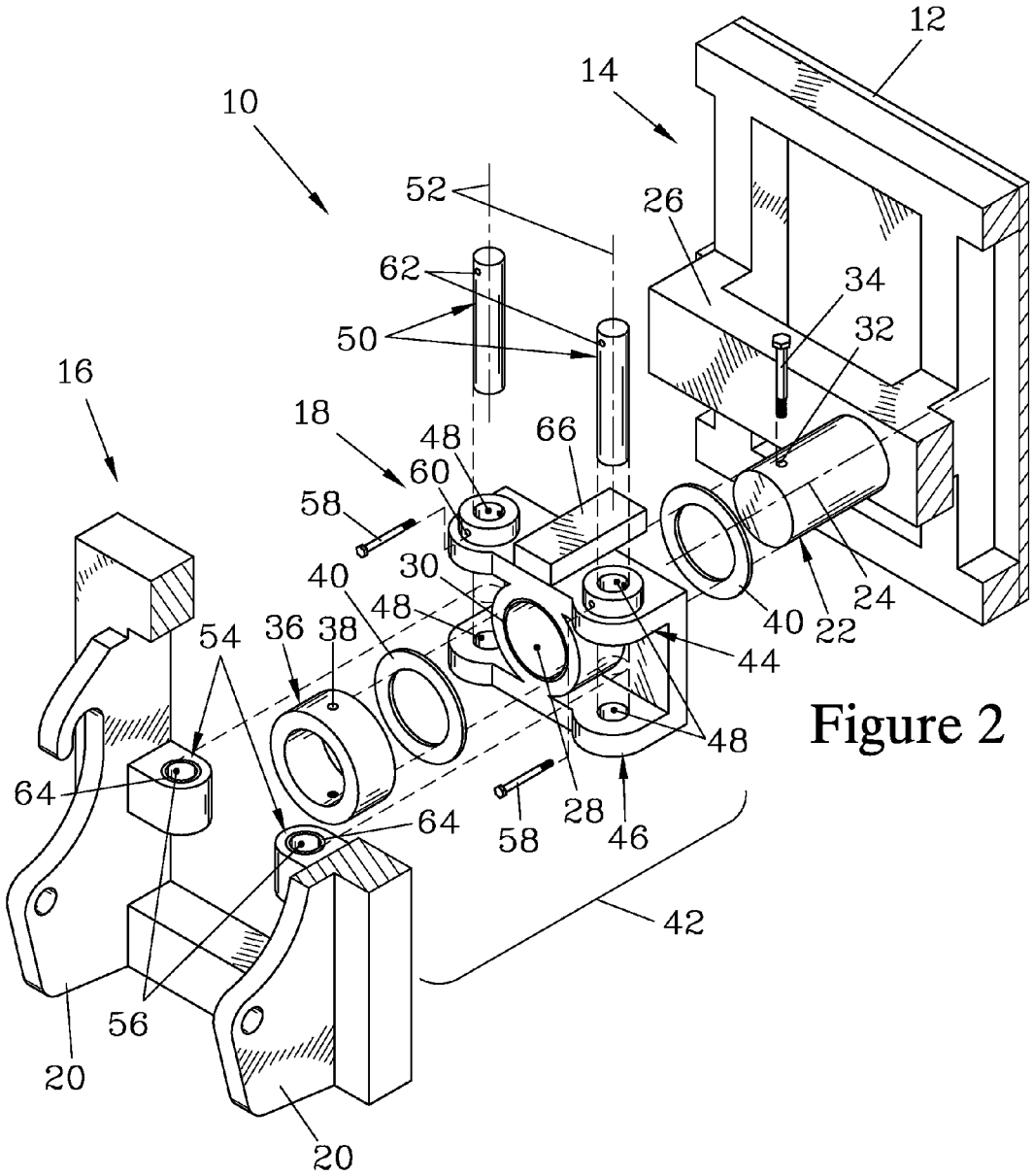
FIG. 2 is an exploded view showing further details of how the pivot bracket shown in FIG. 1 is connected to the remaining structures. The pivot bracket has a bracket passage therethrough configured to slidably engage the pivot shaft, and a retaining collar is provided that attaches to the pivot shaft to trap the pivot bracket thereon. To engage the pivot bracket with the mounting frame, the guides are provided by a pair of guide pins that slide into guide passages in the top and bottom plates of the pivot bracket. The guide pins are inserted into the passages while the sleeves of the mounting frame are positioned between the top and bottom plates with sleeve passages aligned with the guide passages. When the guide pins are installed, the sleeves are trapped on the guide pins between the top and bottom plates.
Figure 3:
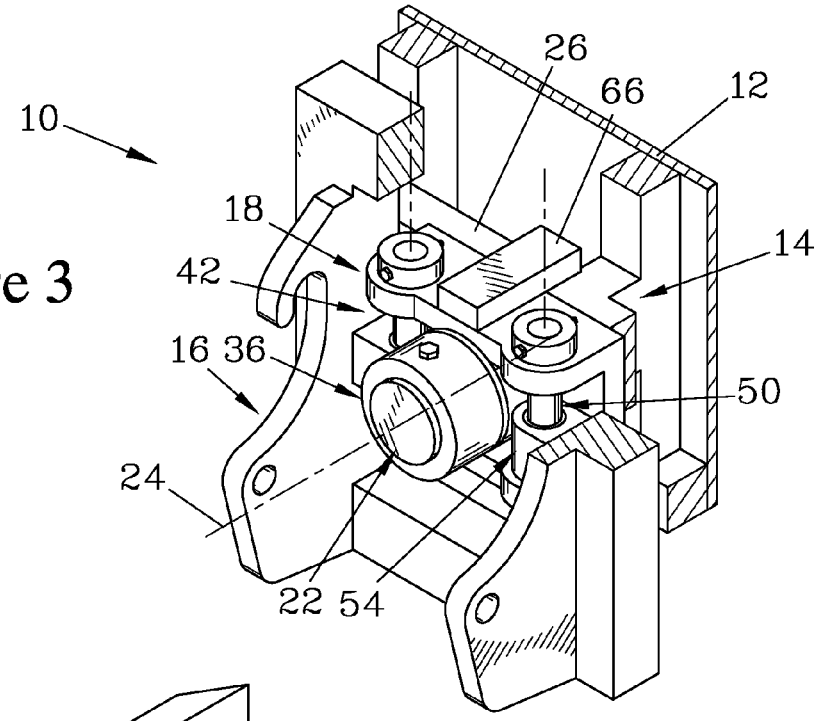
FIG. 3 is an isometric view showing the pivot bracket shown in FIGS. 1 and 2 when connected to the fixed frame and the mounting frame.

FIGS. 1-3 illustrate a float mechanism 10 that is designed for supporting a material moving implement such as a snowplow 12 to allow the snowplow 12 to move freely to traverse uneven ground surfaces while being supported on a vehicle (not shown). The float mechanism 10 has a fixed frame 14 that is affixed to the snowplow 12, and can be made an integral part thereof. The float mechanism 10 also has a mounting frame 16 that is connected to the fixed frame 14 by a pivot bracket 18. The mounting frame 16 in turn has a pair of substantially vertical supports 20 that are configured to releasably engage a conventional instant transfer connector on the vehicle, such as the instant transfer provided by Caterpillar Inc.

The fixed frame 14 has a pivot shaft 22 that extends along a pivot axis 24. The pivot axis 24 is substantially horizontal when the float mechanism is in service, and extends in the direction of travel of the vehicle. In the float mechanism 10, the pivot shaft 22 is mounted to a centrally-located cross-brace 26 that is affixed to the remainder of the fixed frame 14. The pivot bracket 18 has a bracket passage 28 therethrough, which is lined with an appropriate weight-bearing low-friction bracket bushing 30 that slidably engages the pivot shaft 22 on the fixed frame 14. The bracket bushing 30 can be a conventional grooved metal bushing. The pivot shaft 22 has a length sufficient that it extends beyond the bracket passage 28. As shown in FIG. 2, a pivot shaft passage 32 is provided through the pivot shaft 22 to accommodate a pivot shaft bolt 34. A retaining collar 36 is configured to slidably engage the portion of the pivot shaft 22 that extends beyond the bracket passage 28, and has a collar passage 38 into which the pivot shaft bolt 34 can be threadably secured. When the pivot bracket 18 and the retaining collar 36 are slidably engaged on the pivot shaft 22, the collar passage 38 is aligned with the pivot shaft passage 32 and the pivot shaft bolt 34 can be inserted into the aligned passages (32, 38) to retain the retaining collar 36 on the pivot shaft 22 with the pivot bracket 18 trapped between the retaining collar 36 and the fixed frame 14, as shown in the assembled view of FIG. 3. Preferably, bracket washers 40 of a durable, low-friction material such as nylon are interposed between the pivot bracket 18 and the fixed frame 14, and between the pivot bracket 18 and the retaining collar 36 (as best shown in the exploded view of FIG. 2).

The pivot bracket 18 in turn is connected to the mounting frame 16 by a slide mechanism 42 that allows limited translation between the pivot bracket 18 and the mounting frame 16, this motion being limited to translation in a plane that is normal to the pivot axis 24. As shown in FIG. 2, the pivot bracket 18 is provided with a top plate 44 and a bottom plate 46, each having a pair of guide passages 48 into which guide pins 50 can be inserted. The guide passages 48 are centered on guide axes 52 which reside in a plane that is normal to the pivot axis 24; typically, the guide axes 52 are substantially vertical.

The mounting frame 16 has a pair of sleeves 54, each having a sleeve passage 56 that is sized to slidably engage one of the guide pins 50. When the sleeves 54 are placed between the top plate 44 and the bottom plate 46 with the sleeve passages 56 aligned with the guide passages 48, the guide pins 50 can be inserted into the aligned passages (48, 56) and secured to the pivot bracket 18 by guide pin bolts 58 that each pass through a bracket pin passage 60 on the pivot bracket 18 and a guide pin passage 62 through one of the guide pins 50. The sleeve passages 56 are preferably lined with sleeve bushings 64 of a durable, low friction material such as nylon.

When the fixed frame 14, the mounting frame 16, and the pivot bracket 18 are so connected, the snowplow 12 is free to rotate about the pivot axis 24 to accommodate changing angles of road surfaces over which the snowplow 12 is operated. Additionally, the slidable engagement between the pivot bracket 18 and the mounting frame 16 allows the snowplow 12 a limited degree of vertical translation along the guide axes 52 to allow the snowplow 12 to ride over small obstructions.

While the position of the snowplow 12 is typically limited by the ground surface to be traversed, it is frequently desirable to limit the rotation of the snowplow 12 to maintain it in a generally horizontal position when lifted from the ground. The rotation of the snowplow 12 can be limited by means for limiting the rotation between the fixed frame 14 and the mounting frame 16. One example of such means, shown in FIGS. 1-3, is to provide a stop protrusion 66 affixed to the pivot bracket 18 and positioned to engage the cross-brace 26 of the fixed frame 14 when the fixed frame 14 rotates relative to the pivot bracket 18 by a predetermined angle.

While the float mechanism 10 can provide more stable support to the snowplow 12 than earlier float mechanisms, it relies solely on the connections of the pivot bracket 18 to maintain the motion of the fixed frame relative to the mounting frame constrained within a plane. This places great requirements for structural integrity on the pivot bracket, and makes it highly susceptible to wear. These disadvantages can be reduced by employing means for limiting the rotation between the fixed frame and the mounting frame that also aid in limiting the motion between these elements to motion within a plane.

Figure 4:
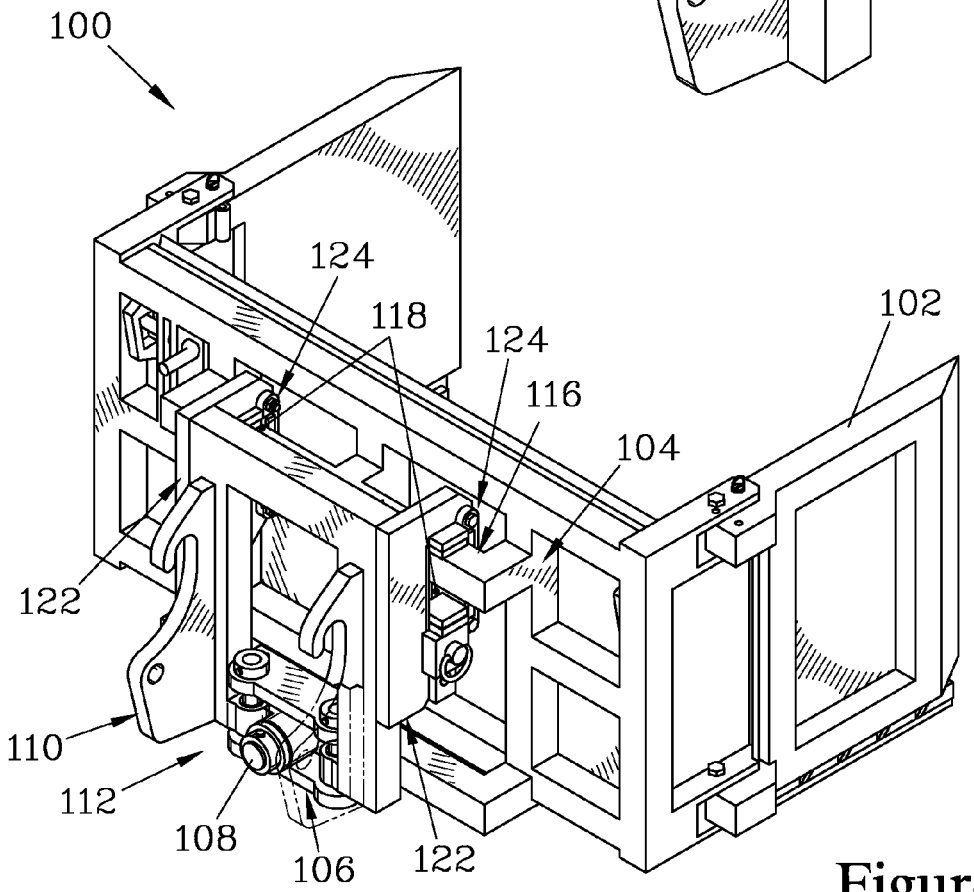
FIG. 4 is an isometric view that illustrates another float mechanism of the present invention; this embodiment provides greater stability for the implement attached to the fixed frame. In this float mechanism, pivoting of the fixed frame relative to the mounting frame is further limited by a pair of substantially vertical slots that are slidably engaged by a transfer bar that serves as a stabilizing element as well as reducing bending moments on the pivot bracket. As illustrated, the transfer bar is affixed to the fixed frame, spaced apart vertically from the pivot shaft, and the slots are provided on the mounting frame. The slots are formed by slot plates affixed to the mounting frame in combination with closure plates that attach to the slot plates to close the remaining side of the slots. The use of a pair of slots to engage the transfer bar provides an effective three-point support for the implement to increase stability and reduce bending moments on the pivot shaft.
Figure 5:
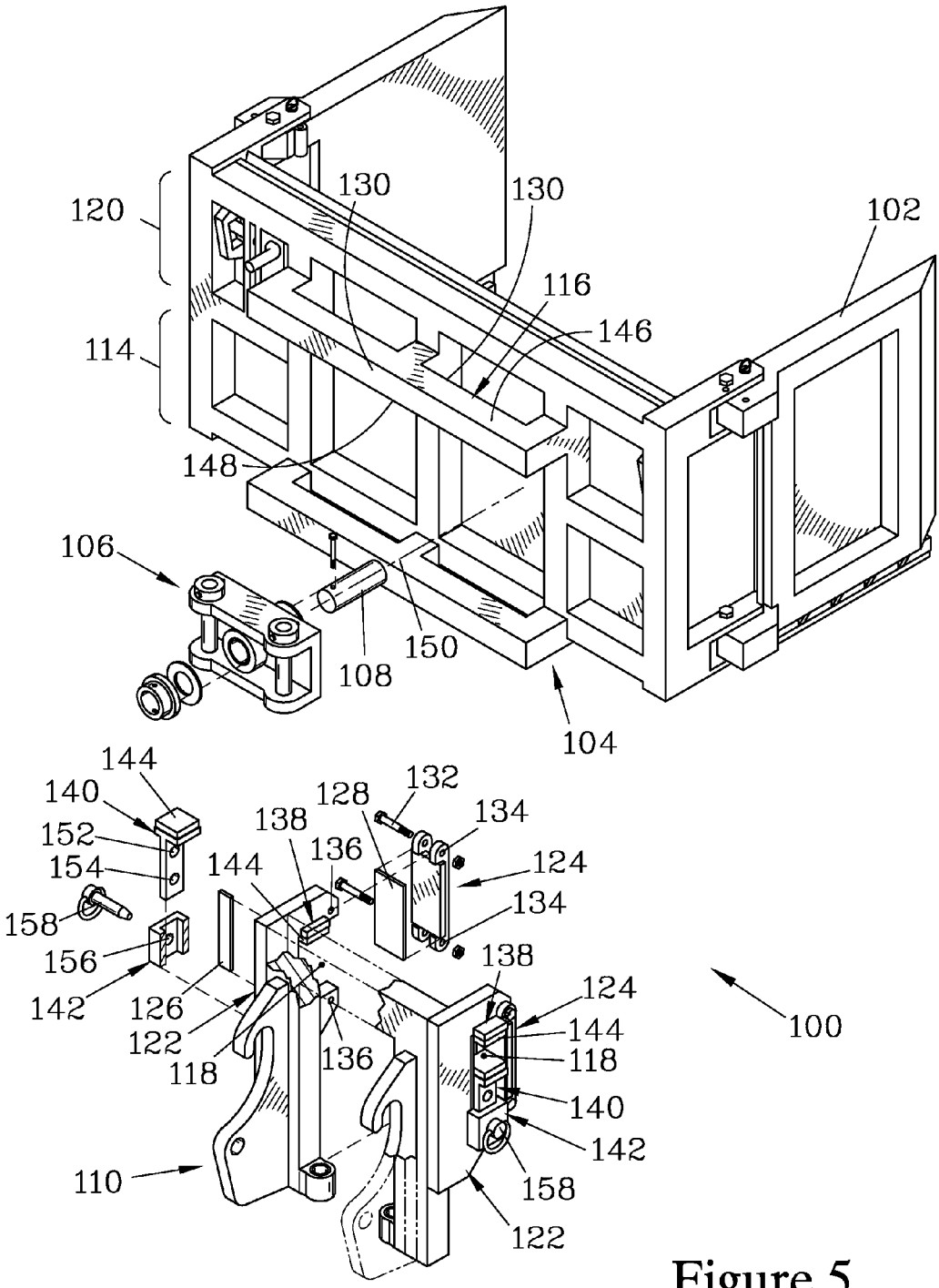
FIG. 5 is an isometric view of the embodiment shown in FIG. 4 when partially exploded to show further details of the structure associated with the vertical slots, including extendable blocks that can be positioned to immobilize the transfer bar in the slots to provide a rigid connection between the mounting frame and the fixed frame.

FIGS. 4 and 5 illustrate a float mechanism 100, which provides greater stability for an implement 102 attached to a fixed frame 104 compared to the float mechanism 10 discussed above. Again, a pivot bracket 106 is rotatably mounted to a pivot shaft 108 on the fixed frame 104, and is connected and to a mounting frame 110 by a slide mechanism 112. However, the float mechanism 100 differs in the means for limiting rotation between the fixed frame 104 and the mounting frame 110 that are employed.

In the float mechanism 100, the pivot shaft 108 is located in a lower region 114 of the fixed frame 104; this position of the pivot shaft 108 will tend to reduce the moment of torques on the pivot bracket 106 resulting from forces transmitted by the implement 102 when in operation. Rotation of the fixed frame 104 relative to the mounting frame 110 is limited by a transfer bar 116 that is slidably restrained by engagement with a pair of guide slots 118. The use of a pair of guide slots 118 to engage the transfer bar 116 provides an effective three-point support for the implement 102 to further reduce bending moments on the pivot shaft 108 and the pivot bracket 106, as well as increasing the stability of the implement 102 when in motion.

The transfer bar 116 in this embodiment is affixed to the fixed frame 104 so as to extend substantially horizontally, and is spaced apart vertically from the pivot shaft 108 so as to be located in an upper region 120 of the fixed frame 104. The guide slots 118 are provided on the mounting frame 110, and extend substantially vertically, extending parallel to the direction of motion provided by the slide mechanism 112. The guide slots 118 are each formed by a slot plate 122 affixed to the mounting frame 110, in combination with a closure plate 124 that attaches to the slot plate 122 to close the remaining side of the guide slot 118. The slot plate 122 and the closure plate 124 are each provided with a replaceable bearing surface (126, 128) of a durable, low-friction material such as nylon. The transfer bar 116 has a pair of opposed bar vertical sides 130, and when the closure plate 124 is attached to the slot plate 122 with the transfer bar 116 interposed therebetween, the bearing surfaces (126, 128) are positioned against the bar vertical sides 130 to limit the motion of the transfer bar 116 relative to the guide slot 118 to motion within a nominally vertical plane. Each of the closure plates 124 can be attached to its associated the slot plate 122 by bolts 132 that are inserted through aligned passages (134, 136) in the closure plate 124 and the slot plate 122.

Rotation of the fixed frame 104 with respect to the mounting frame 110 is limited by the motion of the transfer bar 116 in the guide slots 118. Each of the slot plates 122 has a slot upper plate 138 that defines an upper end of the guide slot 118, while a lower end of the guide slot 118 is defined by a blocking plate 140 that slidably engages a block mounting bracket 142 affixed to the slot plate 122. Both the slot upper plate 138 and the blocking plate 140 are preferably provided with resilient pads 144 for respectively engaging a bar upper surface 146 and a bar lower surface 148 of the transfer bar 116 to limit its movement with respect to the guide slot 118. As the fixed frame 104 rotates with respect to the mounting frame 110 about a pivot axis 150 defined by the pivot shaft 108, at some point the bar upper surface 146 or the bar lower surface 148 will engage one of the resilient pads 144, this engagement serving to block further rotation in that direction.

When the blocking plates 140 that form the lower ends of the guide slots 118 are movably mounted to the mounting frame 110, they can allow the float mechanism 100 to be disabled to provide a rigid connection between the mounting frame 110 and the fixed frame 104. This can be beneficial when the implement 102 is capable of being used as a loader bucket; such an implement that can be configured to operate either as a plow or as a loader bucket is taught in U.S. Pat. No. 7,360,327.

In the float mechanism 100, each of the blocking plates 140 has an upper block passage 152 and a lower block passage 154 therethrough, either of which can be aligned with a block bracket passage 156 in the block mounting bracket 142 to allow a block pin 158 to be passed through the aligned passages (152 or 154, 156) to fix the position of the blocking plate 140 with respect to the slot plate 122. When the block upper passage 152 is aligned with the block bracket passage 156 and pinned, the blocking plate 140 is fixed in a retracted position (as shown in FIG. 4) where it is spaced apart from the slot upper plate 138 by a sufficient distance to allow the desired degree of movement of the transfer bar 116 in the guide slot 118. However, when the blocking plate 140 is positioned such that the block lower passage 154 is aligned with the block bracket passage 156, passing the block pin 158 through the aligned passages (154, 156) fixes the blocking plate 140 in an extended position (shown in FIG. 5) where its separation from the slot upper plate 138 (measured between the opposed surfaces of the resilient pads 144) is about the same as the separation between the bar upper surface 146 and the bar lower surface 148 of the transfer bar 116, thereby preventing vertical movement of the transfer bar 116 in the guide slot 118. Since horizontal motion of the transfer bar 116 relative to the guide slot 118 is prevented by the connection of the pivot bracket 108 to the fixed frame 104 and the mounting frame 110, pinning the blocking plates 140 into their extended positions effectively immobilizes the fixed frame 104 relative to the mounting frame 110, allowing the implement 102 to be used as a loading bucket without undesirable free movement resulting from shifting of loads supported by the implement 102.

Figure 6:
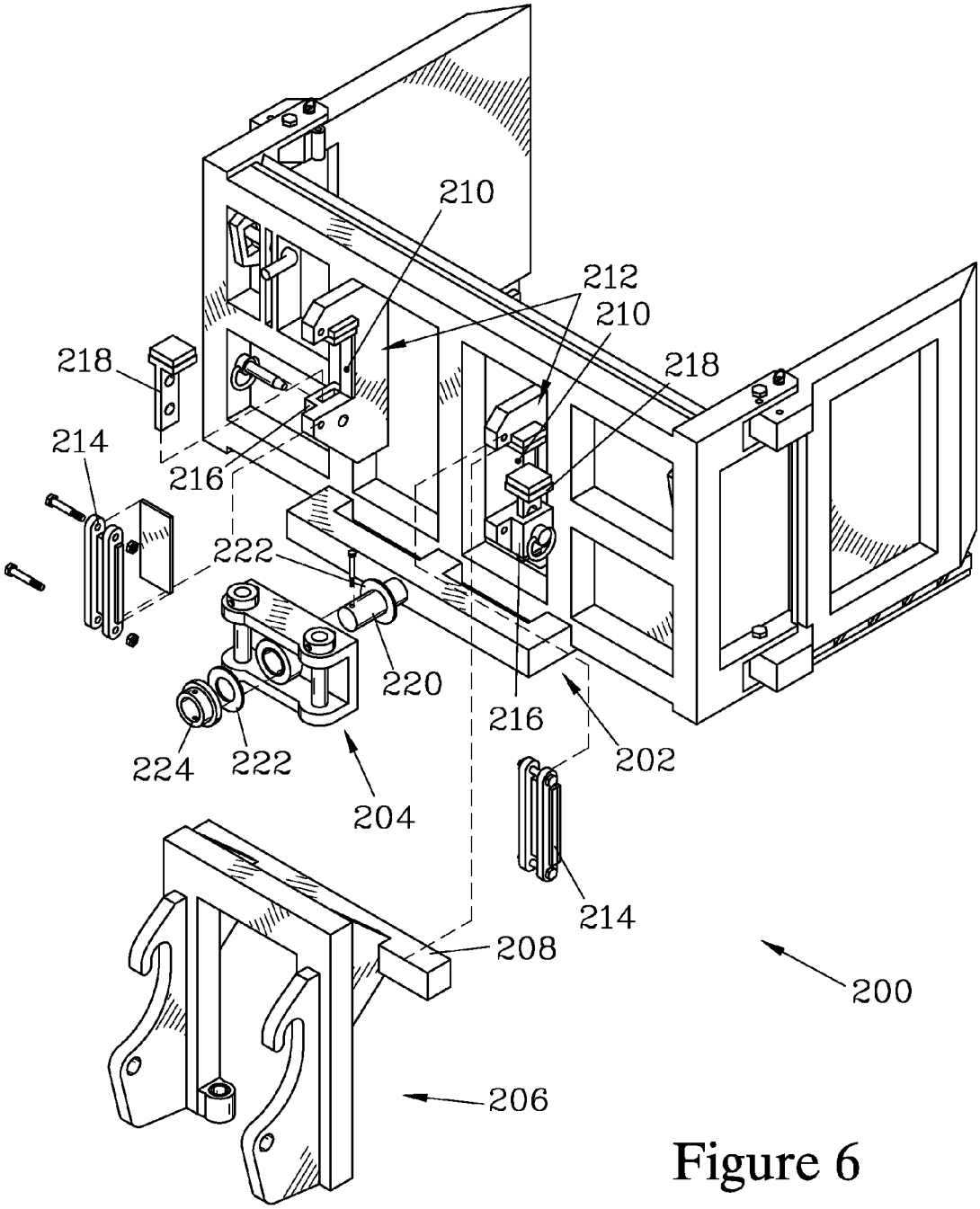
FIG. 6 is an isometric view illustrating an embodiment similar to that shown in FIGS. 4 and 5, but where two vertical slots are provided on the fixed frame and engage a transfer bar attached to the mounting frame.

FIG. 6 is an isometric view of a float mechanism 200 which shares many features in common with the float mechanism 100 discussed above, having a fixed frame 202 that is pivotably connected to a pivot bracket 204 which in turn is slidably connected to a mounting frame 206. In the float mechanism 200, rotation of the fixed frame 202 with respect to the mounting frame 206 is again provided by a transfer bar 208 that is slidably engaged in a pair of guide slots 210. However, in this embodiment, the transfer bar 208 is affixed to the mounting frame 206, while the guide slots 210 are formed by slot plates 212 affixed to the fixed frame 202, in combination with closure plates 214. The closure plates 214 attach to the slot plates 212 with the transfer bar 208 trapped therebetween. Again, the slot plates 212 are each provided with a block mounting bracket 216 in which a blocking plate 218 can be affixed in either an extended or retracted position. With respect to the third stabilizing element to prevent tilting between the frames (202, 206) such is provided by the pivot bracket 204 which engages a pivot shaft 220 and is further stabilized by washers 222 and a retaining collar 224.

FIGS. 7 and 8 illustrate an alternative float mechanism 300, which again has a fixed frame 302 pivotably connected to a pivot bracket 304 that in turn slidably engages a mounting frame 306. In this embodiment, the fixed frame 302 is stabilized with respect to the mounting frame 306 by a pair of guide slots 308 that extend horizontally along the fixed frame 302, in combination with a pair of vertically-extending guide bars 310 affixed to the mounting frame 306. However, in the float mechanism 300 illustrated, the guide slots 308 and the guide bars 310 are not employed to limit the rotation of the fixed frame 302 relative to the mounting frame 306.

The fixed frame 302 is provided with a horizontally-extending slot bar 312 that is provided with a slot bearing surface 314 of a durable, low-friction material. A series of slot brackets 316 are also provided, to which a closure bar 318 can be attached by slot bar bolts 320. The closure bar 318 has a bar bearing surface 322 of a durable, low-friction material, positioned so as to be opposed to the slot bearing surface 314 when the closure bar 318 is secured to the slot brackets 316, these opposed surfaces (314, 322) defining parallel sides of the guide slots 308.

The guide bars 310 are each provided on a guide plate 324 affixed to the mounting frame 306. The guide bars 310 have opposed guide surfaces 326 spaced apart to slidably engage the slot bearing surface 314 and the bar bearing surface 322, to provide additional support regions between the frames (302, 306), thereby reducing the torques on the pivot bracket 304.

While the slot brackets 316 which serve to terminate the guide slots 308 and the guide bars 310 could serve to limit the rotation of the fixed frame 302 with respect to the mounting frame 306, in this embodiment such rotation is more restrictively limited by stops 328 on the fixed frame 302 that are positioned to engage the guide plates 324 to limit such rotation, thereby providing a narrower limit of motion. Preferably, the stops 328 are each provided with a resilient pad 330.

This embodiment also employs a different scheme for deactivating the float mechanism 300 for use supporting a loading bucket. The guide plates 324 are each provided with a guide plate passage 332, which can be aligned with closure bar passages 334 provided in the closure bar 318. When so aligned, deactivation pins 336 can be inserted into the aligned passages (332, 334) to prevent movement of the fixed frame 302 with respect to the mounting frame 306.

Figure 9:
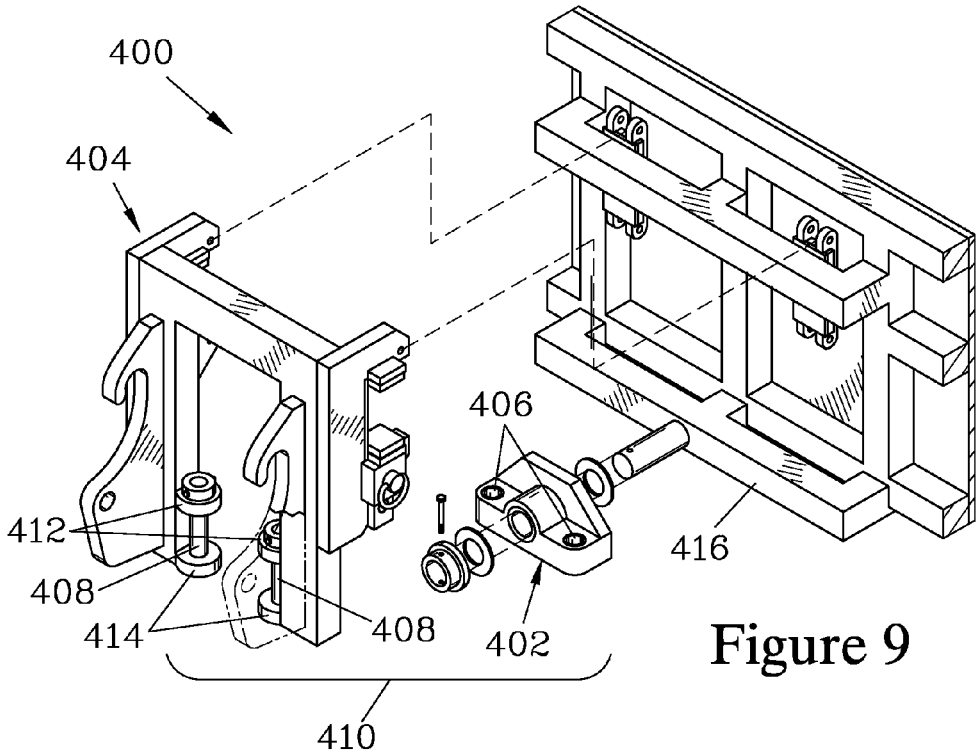
FIG. 9 is a partially-exploded isometric view showing an embodiment similar to that shown in FIGS. 4 and 5, but where the pivot bracket is provided with sleeves that slidably engage guides provided on the mounting frame.

FIG. 9 illustrates a float mechanism 400 that has many features in common with the float mechanism 100 shown in FIGS. 4 and 5, but which differs in the connection between a pivot bracket 402 and a mounting frame 404. In this embodiment, the pivot bracket 402 is provided with bracket sleeves 406 that are configured to slidably engage guides 408 that are attached to the mounting frame 404 so as to provide a slide mechanism 410. The guides 408 each terminate at a top plate 412 and a bottom plate 414 to limit the slidable engagement between the pivot bracket 402 and the mounting frame 404. The pivot bracket 402 in turn is pivotably mounted to a fixed frame 416 in a manner similar to the connection between the pivot bracket 18 and the fixed frame 14 discussed in detail above with regard to FIGS. 1-3.

Figure 10:
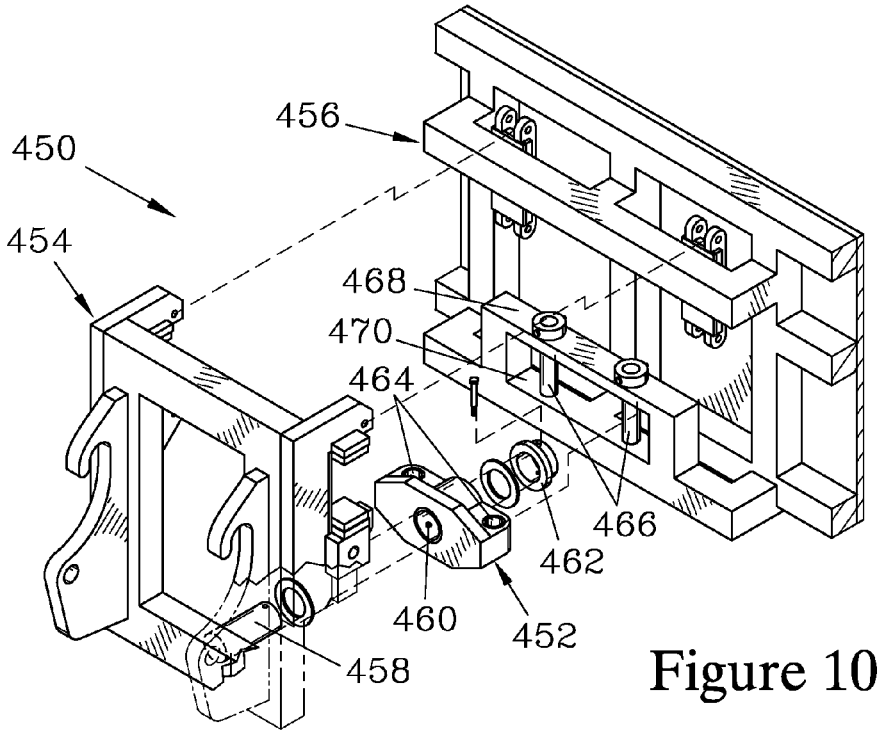
FIG. 10 is a partially-exploded isometric view showing an embodiment similar to that shown in FIG. 9, but where the pivot bracket engages a pivot shaft on the mounting frame, and has sleeves that slidably engage guides mounted to the fixed frame.

FIG. 10 illustrates another alternative embodiment, a float mechanism 450 where a pivot bracket 452 is pivotably connected to a mounting frame 454 and slidably connected to a fixed frame 456. In this embodiment, the mounting frame 454 is provided with a pivot shaft 458 that slidably engages a bracket passage 460 through the pivot bracket 452. A retaining collar 462 attaches to the pivot shaft 458 to trap the pivot bracket 452 thereon to pivotably connect the pivot bracket 452 to the mounting frame 454.

The pivot bracket 452 in turn has a pair of bracket sleeves 464 that slidably engage a pair of guides 466 that are mounted to the fixed frame 456 to allow a limited degree of translational motion between the pivot bracket 452 and the fixed frame 456. The translation is limited by a top plate 468 and a bottom plate 470.

While the novel features of the present invention have been described in terms of particular embodiments and preferred applications, it should be appreciated by one skilled in the art that substitution of materials and modification of details can be made without departing from the spirit of the invention.

What I claim is:

1. A float mechanism for attaching a material-moving implement to an instant transfer connecter on a vehicle to provide a floating connection to accommodate irregularities in the surface over which the vehicle travels, the float mechanism comprising:

a mounting frame having, a pair of substantially vertical supports affixed at a set separation, said pair of substantially vertical supports being so separated and each having a rear profile configured to slidably and lockably engage the instant transfer connector;

a fixed frame attached to the material-moving implement;

a pivot bracket, said pivot bracket being pivotably attached with respect to one of said fixed frame and said mounting frame, so as to rotate about a pivot bracket axis that is substantially horizontal and substantially parallel to the direction of travel of the vehicle, and said pivot bracket being slidably connected with respect to the other of said fixed frame and said mounting frame, so as to allow limited translational motion therebetween along a nominally vertical axis, thereby assuring that the motion between said fixed frame and said mounting frame is substantially maintained within a nominally vertical plane.

2. The float mechanism of claim 1 further comprising:

means for limiting rotation between said fixed frame and said mounting frame.

3. The float mechanism of claim 2 wherein said pivot bracket is located in a lower region of the float mechanism and said means for limiting rotation between said fixed frame and said mounting frame further comprises:

at least one slot affixed with respect to an upper region of one of said fixed frame and said mounting frame, said at least one slot extending along a plane that is substantially normal to said bracket pivot axis; and at least one stabilizing element affixed to the other of said fixed frame and said mounting frame, said stabilizing element being configured to slidably engage said at least one slot, said at least one slot being configured to limit sliding and rotation of said stabilizing element therein.

4. The float mechanism of claim 3 wherein said at least one slot further comprises a pair of substantially vertical slots and said stabilizing element is provided by a horizontally-extending transfer bar configured to slidably engage said substantially vertical slots.

5. The float mechanism of claim 4 wherein said substantially vertical slots are affixed with respect to said mounting frame and said transfer bar is affixed to said fixed frame; and further wherein said pivot bracket is pivotably attached to said fixed frame and is slidably connected to said mounting frame.

6. The float mechanism of claim 5 wherein said pivot bracket is slidably connected to said mounting frame via a slide mechanism that comprises:

a pair of guides affixed to one of said pivot bracket and said mounting frame, said guides being positioned to bracket said pivot bracket axis, and a pair of sleeves affixed to the other of said pivot bracket and said mounting frame and configured to slidably engage said guides.

7. The float mechanism of claim 6 wherein said pair of guides are cylindrical guides affixed with respect to said mounting frame and said pair of sleeves are cylindrical sleeves affixed to said pivot bracket.

8. The float mechanism of claim 6 wherein said pair of guides are cylindrical guides affixed with respect to said pivot bracket and said pair of sleeves are cylindrical sleeves affixed to said mounting frame.

9. The float mechanism of claim 4 wherein said transfer bar has parallel, spaced apart sides which slidably engage said substantially vertical slots.

10. The float mechanism of claim 4 further comprising:

selectively activatable means for blocking vertical motion of said transfer bar with respect to said substantially vertical slots.

11. The float mechanism of claim 10 wherein said means for blocking vertical motion further comprises:

a pair of movable blocks, each of said movable blocks being positionable to block a lower portion of one of said substantially vertical slots so as to block said transfer bar against an upper end of said substantially vertical slot.

12. A float mechanism for attaching a material-moving implement to an instant transfer connector on a vehicle to provide a floating connection therebetween, the float mechanism comprising:

a mounting frame having a portion thereof configured to lockably engage the instant transfer connector;

a fixed frame affixed to the material-moving implement;

a pivot bracket, said pivot bracket pivotably mounting to one of said fixed frame and said mounting frame, so as to rotate about a pivot bracket axis that is substantially horizontal and substantially parallel to the direction of travel of the vehicle when in service, and said pivot bracket slidably connecting to the other of said fixed frame and said mounting frame, so as to allow translation therebetween within a plane normal to the pivot bracket axis.

13. The float mechanism of claim 12 further comprising:

means for limiting translational motion between said mounting frame and said fixed frame; and means for limiting rotation between said fixed frame and said mounting frame.

14. The float mechanism of claim 13 wherein said pivot bracket is located in a lower region of the float mechanism and said means for limiting rotation between said fixed frame and said mounting frame further comprises:

at least one slot affixed with respect to an upper region of one of said fixed frame and said mounting frame, said at least one slot extending along a plane that is substantially normal to said bracket pivot axis; and at least one stabilizing element affixed to the other of said fixed frame and said mounting frame, said stabilizing element being configured to slidably engage said at least one slot, said at least one slot being configured to limit sliding and rotation of said stabilizing element therein.

15. The float mechanism of claim 14 wherein said at least one slot further comprises a pair of substantially vertical slots and said stabilizing element is provided by a horizontally-extending transfer bar configured to slidably engage said substantially vertical slots.

16. The float mechanism of claim 12 wherein said pivot bracket is located in a lower region of the float mechanism, the float mechanism further comprising:

at least one slot affixed with respect to an upper region of one of said fixed frame and said mounting frame, said at least one slot extending along a plane that is substantially normal to said bracket pivot axis; and at least one stabilizing element affixed to the other of said fixed frame and said mounting frame, said stabilizing element being configured to slidably engage said at least one slot, said at least one slot being configured to limit sliding and rotation of said stabilizing element therein.

17. The float mechanism of claim 16 wherein said at least one slot further comprises a pair of substantially vertical slots and said stabilizing element is provided by a horizontally-extending transfer bar configured to slidably engage said substantially vertical slots.

18. The float mechanism of claim 17 further comprising:

selectively activatable means for blocking motion of said transfer bar with respect to said substantially vertical slots.

* * * * *